United States Patent [19]

Chapel

[11] 3,949,900

[45] Apr. 13, 1976

[54] CHEMICAL DISPENSER

[76] Inventor: William I. Chapel, 1145 Country Club Drive, Warsaw, Ind. 46580

[22] Filed: Oct. 23, 1974

[21] Appl. No.: 517,177

[52] U.S. Cl. ..... 222/54
[51] Int. Cl.[2] ..... E03D 9/02
[58] Field of Search ..... 222/464, 54; 4/228, 231; 23/267 A

[56] References Cited

UNITED STATES PATENTS

| | | | |
|---|---|---|---|
| 634,515 | 10/1899 | Wade | 4/228 |
| 650,161 | 5/1900 | Williams et al. | 4/228 |
| 3,781,926 | 1/1974 | Levey | 4/228 |
| 3,837,017 | 9/1974 | McDuffee | 4/228 |

FOREIGN PATENTS OR APPLICATIONS

| | | | |
|---|---|---|---|
| 8,924 | 3/1893 | United Kingdom | 4/228 |

*Primary Examiner*—Stanley H. Tollberg
*Attorney, Agent, or Firm*—Woodhams, Blanchard and Flynn

[57] ABSTRACT

A dispensing device adapted to be disposed within a toilet tank for sanitizing the tank and the bowl. The dispensing device includes a substantially closed receptacle containing therein a suitable dry chemical, such as calcium hypochloride, which mixes with water to form a saturated solution within the receptacle. A standpipe of selected diameter and length extends through the top wall of the receptacle to permit communication between the interior of the receptacle and the interior of the tank. During flushing of the tank, the turbulence of the flow within the tank causes a metered amount of saturated solution to be withdrawn from the dispensing device and mixed with the tank water. By using a standpipe having a preselected diameter and length, optimum and uniform diffusing of the chemical solution through the standpipe is achieved.

4 Claims, 2 Drawing Figures

CHEMICAL DISPENSER

FIELD OF THE INVENTION

This invention relates to an improved sanitizing-type dispensing device adapted to be disposed within a toilet tank for permitting optimum and uniform dispensing of suitable chamicals into the water within the tank.

BACKGROUND OF THE INVENTION

Numerous sanitizing-type dispensers have been devised for use with a toilet tank to permit feeding of a chemical into the water within the tank to control problems caused by hydrogen sulfide, maganese and iron, to control algae and slime, and to provide disinfectant. Many of these known dispensers have been suspended in the tank or have been deposited directly on the bottom wall thereof.

While dispensing devices of the above-mentioned type have been widely used, nevertheless their performance has been less than satisfactory. One of the major problems associated with known dispensers is the lack of uniformity in the amount of chemicals dispensed throughout the life of the device. With most of these known dispensers, the receptacle is provided with one or more openings therethrough to permit communication between the chemicals within the receptacle and the water in the tank. Due to the manner in which this communication is provided, it has been discovered that the amount of chemicals which are mixed with the water during the initial stages of operation, such as when the dispensing device is new, is greatly in excess of the amount necessary to permit effective sanitizing of the water. The chemical is thus initially utilized at an inefficient and rapid rate. On the other hand, after the dispenser has been installed within the tank for a substantial period of time, and the chemical is substantially used up, then the quantity of chemical dispensed is inadequate. These prior devices thus do not result in uniform sanitizing of the water.

These known dispensing devices experience still a further common problem since they normally utilize one or more small orifices formed in the wall of the dispenser for providing communication between the dispenser and the surrounding body of water. When the dispenser has been positoned within the water for a period of time, the small orifices become encrusted with solid material which partially or totally closes off the orifices and prevents operation of the dispenser. This problem is particularly severe since most known dispensers utilize extremely small orifices in order to control the dispensing rate of the chemicals.

Accordingly, it is an object of the present invention to provide an improved dispenser which overcomes the above-mentioned disadvantages. Particularly, the objects of the present invention are the provision of:

1. A dispenser, as aforesaid, adapted to be positioned within a toilet tank for permitting effective and efficient sanitizing of the water within the tank.

2. A dispenser, as aforesaid, which permits relatively uniform dispensing of chemicals into the surrounding water throughout the life of the dispenser.

3. A dispenser, as aforesaid, which permits the optimum dispensing of chemicals to permit effective sanitizing of the water, while resulting in efficient use of chemicals so as to substantially increase the usable life of the dispenser.

4. A dispenser, as aforesaid, which is economical to manufacture, is easy to install, is economical and efficient in operation, and is readily disposed of or refilled when the dry chemical has been used up.

5. A dispenser, as aforesaid, which utilizes a standpipe extending between the water and the interior of the dispenser, which standpipe defines an opening therethrough of substantial diameter and axial length to provide uniform dispensing of chemicals and at the same time eliminate the problem of the opening becoming closed due to the encrustation of solid material.

Other objects and purposes of the present invention will be apparent to persons acquainted with devices of this type upon reading the following specification and inspecting the accompanying drawings.

Figure 1:
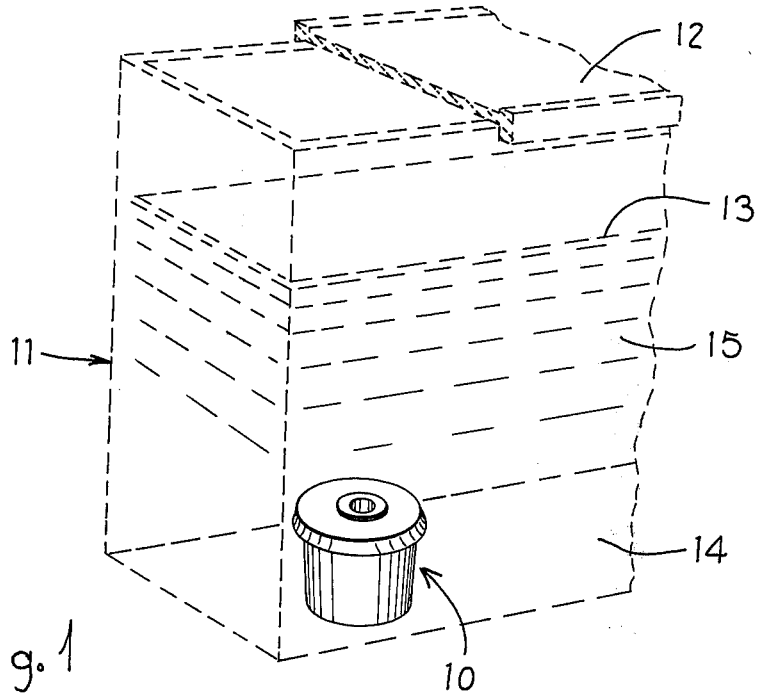
FIG. 1 is a broken, perspective view of a dispenser constructed according to the present invention and positioned within a toilet tank.

Certain terminology will be used in the following description for convenience in reference only and will not be limiting. For example, the words "upwardly", "downwardly", "rightwardly" and "leftwardly" will refer to directions in the drawings to which reference is made. The words "inwardly " and "outwardly" will refer to directions toward and away from, respectively, the geometric center of the dispenser and designated parts thereof. Said terminology will include the words above specifically mentioned, derivatives thereof and words of similar import.

SUMMARY OF THE INVENTION

The objects and purposes of the present invention are met by providing a substantially closed receptacle containing therein a quantity of dry chemicals, such as calcium hypochlorite and/or potassium permanganate. A sleevelike standpipe is mounted on the receptacle and extends through the top wall thereof, which standpipe defines an opening having a substantial diameter and a substantial axial length. The standpipe provides communication between the interior of the receptacle and the surrounding body of water when the dispenser is positioned within a toilet tank. The standpipe permits water to enter the receptacle and mix with the chemicals to form a saturated chemical solution within the receptacle. The large diameter opening in the standpipe prevents the opening from becoming encrusted with solid materials. The substantial axial length of the standpipe restricts the dispensing of the chemicals from the receptacle so that upon flushing of the tank, the turbulence of the water within the tank flowing over the open upper end of the standpipe causes a limited quantity of the chemical to flow upwardly out of the standpipe, as by osmotic pressure, so as to be dispensed into the body of water. Optimum and uniform dispensing of the chemicals is thereby achieved. In a practical embodiment of the invention, the opening in the standpipe preferably has a diameter and an axial length which are of similar magnitudes, with the diameter preferably being in the range of between ½ and 180 inches, and the axial length also preferably being in the range of between ½ and 1 ½ inches.

DETAILED DESCRIPTION

FIG. 1 illustrates therein an improved santitizing-type dispenser 10 disposed within a conventional toilet tank 11. Tank 11 includes a removable cover 12 and contains therein a reservoir or body of water 15 which has a maximum elevation illustrated by the dotted line 13. The dispenser 10 is removably positioned within the tank 11 and, in the illustrated embodiment, is deposited on the bottom wall 14 thereof.

Figure 2:
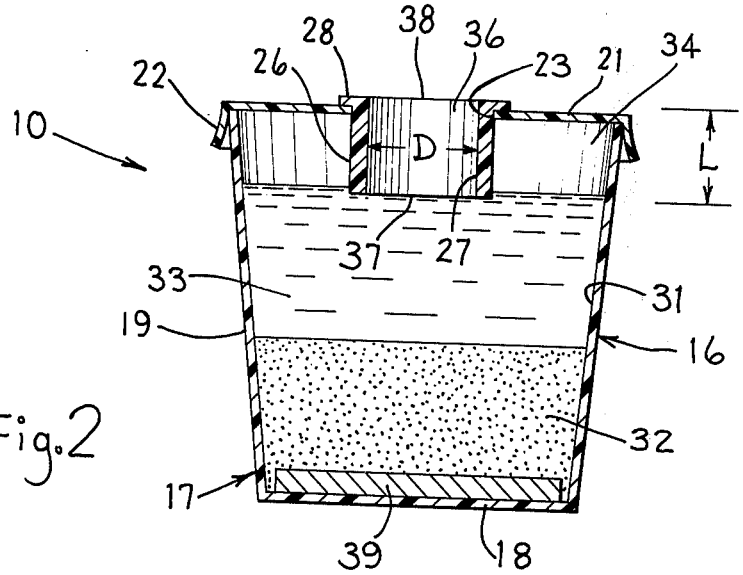
FIG. 2 is a central cross-sectional view of one embodiment of a dispenser to the present invention.

One embodiment of the dispenser 10 constructed according to the present invention is illustrated in FIG. 2, and same includes a substantially closed container 16 which is in part defined by an upwardly opening cup-shaped receptacle 17 having a bottom wall 18 and a substantially cylindrical sidewall 19. The receptacle 17 is closed by a removable cover 21 which has an annular resilient rim 22 formed thereon and projecting axially therefrom. The rim 22 is adapted to resiliently and sealingly engage the upper edge of the annular sidewall 19 so as to snugly and sealingly hold the cover 21 on the receptacle 17. If desired, the upper edge of the sidewall 19 and the rim 21 can be provided with coacting resilient detents.

The cover 21 has a central opening 23 formed therein, which opening accommodates a sleevelike standpipe 26. The standpipe 26 is snugly and sealingly engaged with the cover 21 and defines therein an elongated substantially cylindrical opening 27. Standpipe 26, in the illustrated embodiment, has a flange 28 on the upper end thereof which overlaps the cover 21 for preventing separation between the cover and the standpipe.

The container 16 defines therein a substantially closed compartment 31 which is isolated from the body of water 15 except for the communication provided by the opening 27. Compartment 31 contains therein a quantity of a solid chemical 32, which chemical may comprise calcium hypochlorite and/or potassium permanganate. The chemical occupies only a part of the compartment 31, and a substantial portion of the remainder of the compartment 31 is filled with a liquid 33 which constitutes a saturated chemical solution formed by the chemical 32 when mixed with water which enters the compartment 31 from the body of water 15. The saturated solution 33 extends upwardly to a level at least equal to or slightly beyond the lower end of the standpipe 26, with the remaining portion of the compartment defining an annular space 34 containing a quantity of trapped air thereon. This space 34 may also be filled with the saturated chemical solution under some circumstances.

The standpipe 26, which is of rather large diameter D and is of substantial axial length L, defines therein a mixing chamber 36 which extends from the inlet opening 37 defined at the lower end of the standpipe 26 to the discharge opening 38 as defined at the upper end of the standpipe. Since the opening 37 is disposed in direct communication with the saturated chemical solution 33, and whereas the discharge opening 38 is disposed in direct communication with the body of water 15, and mixing chamber 36 thus contains a chemical concentration which is less than the chemical concentration of the saturated solution 33.

With respect to the diameter D and axial length L of the opening 27, these dimensions are preferably of similar magnitude and preferably proportionately increase or decrease with respect to one another in order for the chemical feed rate to remain substantially the same. For example, when the diameter D is increased, a similar and somewhat proportionate increase is also made in the length L. Similarly, a decrease in the diameter D is also accompanied by a similar and somewhat proportionate decrease in the length L.

In a practical embodiment of the present invention, the diameter D may vary from ½ inch up to approximately 2 ½ inches, and the length L may likewise vary within the same range. However, the diameter D is preferably within the range of ½ to 1 ¾ inches, and the length L is also preferably within the range of ½ to 1 ¾ inches. The feed rate of chemicals from the container is in part controlled by the diameter D, with the feed rate increasing as the diameter D increases, provided that the length L is constant. On the other hand, the feed rate decreases when the length L increases and diameter D is constant.

If necessary, the dispenser 10 can be provided with a suitable ballast or weight 39 so as to maintain the dispenser in a stable condition on the bottom of the tank.

OPERATION

The dispenser 10 initially contains therein the dry solid chemical 32. When the dispenser 10 is positioned with a body of water, such as by being disposed within a toilet tank as illustrated in FIG. 1, the water flows into and fills the container 16 and forms the saturated solution 33. The dispenser 10 then permits limited quantities of chemical to be dispensed outwardly through the standpipe 26 for mixing with the surrounding body of water. This dispensing of the chemical from the dispenser is believed to occur primarily during the flushing operation, during which time the body of water undergoes substantial turbulent action and also undergoes a substantial change in depth. During the flushing operation, the long axial length L of the standpipe 26 prevents the water from flowing directly into the container 16, so that the saturated solution 33 within the container remains in a relatively calm and nonflowing condition. However, the turbulent flow of the water external of the container, and particularly the turbulent flow which exists directly adjacent the discharge opening 38, causes a limited amount of the chemicals as contained within the mixing chamber 36 defined by the standpipe to be dispensed into the surrounding body of water 15. While the exact physical principle causing this dispensing action is not completely known, nevertheless it is believed that the dispensing of the chemical from the solution 33 up into the mixing chamber 36, and thence upwardly into the body of water 15, it is believed due to a condition similar to osmotic pressure. That is, the turbulent movement of the water directly above the discharge opening 38 causes an unbalanced pressure to exist between the openings 37 and 38. This gives rise to the phenomena of diffusion, particularly in the present invention wherein there is a difference in concentration of the chemical solution as located adjacent the opposite ends of the standpipe 26. The chemical solution within chamber 36 thus flows outwardly through the opening 38 so as to be intermixed with the surrounding body of water in the desired proportion, and the standpipe is refilled within clear water. Osmotic pressure then causes some of the chemicals in container 16 to flow upwardly into the standpipe 26 so as to replace the chemical solution therein.

In the present invention, the container 16 is preferably only partially filled with the dry chemical 32 so that, upon depositing same in the body of water, sufficient water will flow into the compartment 31 to result in the formation of the saturated solution 33. This saturated solution 33 continues to exist so long as a quantity of chemical 32 remains in the dispenser. After the chemical has been completely used up, then the dispenser can be readily removed from the toilet tank and disposed of, or as an alternative, the dispenser can be refilled with a selected quantity of chemicals.

To demonstrate the desirable performance of the present invention, experimental tests were conducted on a dispenser according to the present invention and utilizing a standpipe of substantial diameter and axial length therein. A similar experimental test was conducted on a dispenser of substantially identical construction but employing therein a large diameter opening rather than a standpipe. These experimental tests clearly indicate the substantially improved performance achieved by using a dispenser employing therein a standpipe as illustrated in the attached drawing.

Specifically, in the first test, the dispenser was provided with an eight ounce capacity and initially contained four ounces of calcium hypochlorite. The dispenser was provided with a ⅝ inch diameter opening in the cover thereof, but the dispenser was not provided with a standpipe. This dispenser was located in the flush reservoir of a toilet tank, and measurements were made over a period of several days to determine the concentration of the chemicals within the flush tank. The measurements, which were taken on six different days while utilizing this dispenser, indicated a substantial variation in the concentration of the calcium hypochlorite in the flush tank, with the measurements for these 6 days being 36, 8, 11, 30, 25 and 18 parts per million (ppm) respectively. As these test results readily indicate, the dispenser employing a large diameter opening, and not having a standpipe, results in the chemical concentration in the flush tank varying over a rather wide range, which range varies from 8 ppm to 36 ppm. This wide variation in the concentration is totally undesirable. Also, even the minimum concentration which resulted from this dispenser is substantially more than that necessary to achieve optimum sanitizing of the water. The chemical is thus dispensed from the dispenser in a very nonuniform and excessive manner, which results in very inefficient and rapid utilization of the chemical.

On the other hand, a second test was conducted on a second dispenser constructed according to the present invention. The second dispenser was identical to the dispenser utilized in the first test, described above, except that the dispenser was provided with a standpipe extending through the cover of the dispenser. The standpipe had an opening of ⅝ inch internal diameter and ¾ inch axial length. Measurements of the chemical concentration within the flush reservoir were again taken over several days, particularly on ten different days which extended over a period of approximately three weeks, and it was found that these ten measurements were respectively 3, 3, 3, 2.5, 3, 3.5, 3, 3, 3 and 3 ppm. The concentration of the flush reservoir thus varied from 2.5 to 3.5 ppm, thereby indicating that the dispenser of the present invention resulted in a fairly constant and uniform dispensing of chemical into the flush reservoir. Further, not only was the quantity of chemical dispensed extremely uniform, but also the quantity dispensed was substantially less than that dispensed when utilizing a dispenser without a standpipe. Particularly, this smaller quantity of dispensed chemical more closely represents the optimum quantity which results in the desired sanitizing of the water without resulting in wastage of the chemical. The dispenser of the present invention, as illustrated from the results of this second test, thus provides a more uniform and efficient dispenser of the chemicals into the flush tank.

It is desired to feed a different concentration of chemical into the flush tank, then this can be accomplished by slightly varying the standpipe length to thereby provide the desired feed of chemical for a given application, and to thereby provide the desired feed concentration in terms of the desired ppm within the water reservoir. For example, increasing the standpipe length will decrease the chemical feed rate, and decreasing the standpipe length will increase the chemical feed rate. Alternately, the feed rate of chemical from the container into the flush tank can be varied by changing the diameter of the standpipe since the chemical feed rate increases as the diameter increases. The present invention, by permitting uniform dispensing of low concentrations of chemicals, is desirable since the minimization of chemicals within the tank substantially reduces the corrosion of the tank fittings.

While the invention as illustrated in FIG. 2 has the standpipe 26 extending downwardly into the container, it will be apparent that the standpipe could project upwardly above the cover if desired.

While the invention has been disclosed primarily in relationship to its use for sanitizing a toilet tank, nevertheless the present invention is also believed equally applicable for use in controlling the chemical concentration within other tanks. For example, the dispenser of the present invention, by utilization of suitable chemicals therein, is also applicable for use in the brine tank of a water softener to assist in cleaning the softener bed of mineral deposits and buildup. In this type of application, the chemical will be dispensed from the dispenser into the salt brine solution and will be drawn into the mineral tank during regeneration.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A dispenser for use with a reservoir of water for permitting a chemical to be dispensed into said body of water, said dispenser comprising:

container means defining therein a compartment which is partially filled with a solid chemical, said compartment being adapted to have water deposited therein for forming a saturated chemical solution within said compartment;

standpipe means mounted on said container means and having an interior opening therethrough which extends through the wall of said container means for providing the sole communication between said compartment and the surrounding reservoir of water, said standpipe means comrising an axially elongated sleevelike member having said interior opening of rather large cross-section extending axially therethrough, said standpipe means opening upwardly and having the lower end thereof in communication with said saturated solution; and said opening as defined by said standpipe means being of substantially uniform cross-section throughout the complete axial length thereof and being completely open at both the upper and lower ends thereof, and the diameter and axial length of said opening being of similar magnitude with said opening having a diameter of at least one-half inch and an axial length of at least one-half inch.

2. A dispenser according to claim 1, wherein the diameter of the standpipe means is in the range of approximately between ½ and 1 ¾ inches, and wherein the axial length of the standpipe means is in the range of approximately ½ and 1 ¾ inches.

3. In a dispensing device adapted to be positioned within a toilet tank for dispensing a sanitizing chemical into the water reservoir defined by said tank, said dispensing device including a container defining therein a compartment which is partially filled with a solid chemical, and opening means formed in said container for permitting the water in said reservoir to come into contact with said chemicals, comprising the improvement wherein said container is only partially filled with said solid chemical, a portion of the compartment containing therein a saturated chemical solution produced by contacting said solid chemical with water, and said opening means being defined by standpipe means mounted on said container and providing communication between said compartment and said reservoir for permitting dispensing of chemicals from said compartment into said reservoir by osmotic pressure, said standpipe means comprising an axially elongated sleevelike member mounted on said container and projecting through the upper wall thereof, said sleevelike member defining an axially elongated opening therethrough of rather large cross-sectional area, the upper end of said opening being in direct communication with the reservoir and the lower end of said opening being in direct communication with the saturated solution, said opening having both a diameter and an axial length which is at least one-half inch, said container being closed except for the opening provided by said standpipe means.

4. A dispenser for use with a reservoir of water for permitting a chemical to be dispensed into said body of water, said dispenser comprising:

container means defining therein a compartment which is partially filled with a solid chemical, said compartment being adapted to have water deposited therein for forming a saturated chemical solution within said compartment;

said container means including an upwardly opening cup-shaped receptacle and cover means removably mounted on the upper end of said receptacle for closing same;

standpipe means mounted on said cover means and projecting therethrough for providing communication with said compartment, said standpipe means comprising an axially elongated sleevelike member having an internal opening of rather large cross-section extending axially therethrough, said standpipe means opening upwardly and having the lower end thereof in communication with said saturated solution; and said opening as defined by said standpipe means being of substantially uniform cross-section throughout the complete axial length thereof and being completely open at both the upper and lower ends thereof, and the diameter and axial length of said opening being of similar magnitude with said opening having a diameter of at least one-half inch and an axial length of at least one-half inch.

* * * * *